US007505236B2

(12) United States Patent
Kobielski

(10) Patent No.: US 7,505,236 B2
(45) Date of Patent: Mar. 17, 2009

(54) ARC SUPPRESSION CIRCUIT

(75) Inventor: Louis J. Kobielski, Sherman, NY (US)

(73) Assignee: General Electric Company, Schenectady, NY (US)

( * ) Notice: Subject to any disclaimer, the term of this patent is extended or adjusted under 35 U.S.C. 154(b) by 46 days.

(21) Appl. No.: 11/465,003

(22) Filed: Aug. 16, 2006

(65) Prior Publication Data

US 2007/0046233 A1 Mar. 1, 2007

Related U.S. Application Data

(60) Provisional application No. 60/709,967, filed on Aug. 19, 2005.

(51) Int. Cl.
*H01H 9/30* (2006.01)
*H01H 9/42* (2006.01)

(52) U.S. Cl. ..... 361/13

(58) Field of Classification Search ..... 361/2, 361/13

See application file for complete search history.

(56) References Cited

U.S. PATENT DOCUMENTS 3,739,192 A * 6/1973 Oswald ..... 361/3
6,618,235 B1 9/2003 Wagoner et al.
6,621,668 B1 9/2003 Sare
6,885,535 B2 4/2005 Hummert et al.
7,145,758 B2 * 12/2006 King et al. ..... 361/3

* cited by examiner

*Primary Examiner*—Ronald W Leja
(74) *Attorney, Agent, or Firm*—Robert Wawrzyn, Esq.; Terry M. Sanks, Esq.; Beusse Wolter Sanks Mora & Maire, P.A.

(57) ABSTRACT

A contactor arc suppression system for an electric propulsion vehicle having an on-board diesel-electric power generating system for supplying electric power to a plurality of DC electric traction motors for propelling the vehicle in which the traction motors are operable in an electric power generating mode during electrical braking of the vehicle and the vehicle further has a dynamic braking grid selectively coupled in parallel with the traction motors for absorbing the generated electric power during such electrical braking. The system includes at least one contactor having a pair of contact tips arranged to selectively couple the dynamic braking grid into parallel circuit arrangement with the electric traction motors during electrical braking and a snubber circuit having a diode and a first capacitor connected in series circuit arrangement with the snubber circuit connected in parallel with the contact tips of the contactor. A protection circuit for the diode includes a first resistor and a second capacitor connected in series with the protection circuit connected in parallel with the diode. A second resistor is connected in parallel circuit arrangement with the diode for providing a current discharge path for the first capacitor upon closure of the contact tips.

9 Claims, 1 Drawing Sheet

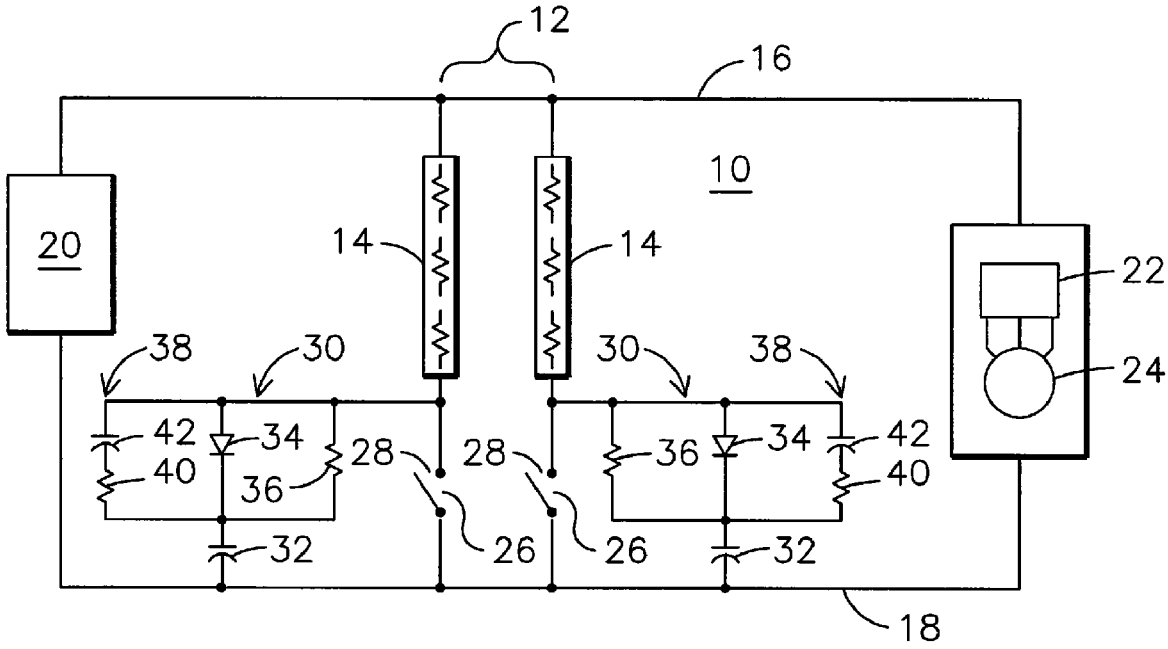
12
16
10
20
14
14
22
24
38
30
30
38
42
34
28
28
36
34
42
40
36
40
32
26
26
32
18

ARC SUPPRESSION CIRCUIT

CROSS-REFERENCE TO RELATED APPLICATION

This application claims the benefit of U.S. provisional application No. 60/709,967, filed Aug. 19, 2005.

FIELD OF THE INVENTION

The present invention relates to dynamic braking circuits for off-highway vehicles and, more particularly, to electronic circuits for suppressing arcing across contactors when the dynamic braking contactors are opened to disengage such braking.

BACKGROUND OF THE INVENTION

Off-highway vehicles of the type for which the present invention is intended are typically very large earth-moving machines that use an internal combustion engine, such as a diesel engine, to drive an alternator that produces electric power. The wheels of the vehicle are propelled by electric motors built into the wheels that are powered from the on-board alternator. See, for example, U.S. Pat. No. 3,897,843 for a general description of such a vehicle wheel. Because the vehicles are propelled by electric motors, the internal combustion engine is not available to assist in slowing the vehicle when the vehicle is switched into a coast mode. Accordingly, such vehicles typically include a dynamic braking circuit that can be switched into circuit with the electric motors. During this time, the momentum of the vehicle drives the motors and the motors are biased so as to act as electric power generators. The amount of retarding force that can be produced by the motors while acting as generators is a function of the amount of current produced by the motors.

When the electric motors of a vehicle are operating in a power generation mode to create a retarding effect on the vehicle, the power generated by the motors must be dissipated and this is usually accomplished by directing the power into a resistive grid, sometimes referred to as a dynamic braking grid. Since it is not desirable to dissipate power in the grid during normal propulsion of the vehicle, the grid is provided with switching devices that can switch the grid into and out of circuit with the motors depending upon the mode of operation of the vehicle, i.e., whether the vehicle is in a propulsion mode or a dynamic braking mode. In electric vehicle applications, the amount of power that may be generated, when measured in terms of voltage and current, can be significant. Motor currents may be in the range of several hundreds of amperes and motor voltage may exceed one thousand volts. Relatively large contactors are therefore used to switch the dynamic braking grid into and out of circuit with the motors.

The contactors used in the above described vehicle applications are generally fast acting solenoid actuated contactors such as a Siemens model 41A296327ALP2 contactor. This type contactor has been shown to clear a contact arc in several milliseconds. However, in off-highway vehicle operation, it is typical for the vehicle operator to cycle the vehicle between propulsion, coast and braking modes on a frequent basis. As a result, the contact tips on these contactors experience significant wear from repetitive arcing at the tips and must be replaced to prevent contactor failure. It is desirable to maximize the time between contactor replacement both to minimize cost of replacement as well as to minimize down-time of the vehicle.

SUMMARY OF THE INVENTION

The inventor has discovered that contactor tip life can be extended by incorporating a snubber or arc suppression circuit into the vehicle system such that the arc suppression circuit is arranged to reduce arcing at the contactor tips. More particularly, the inventor has found that the contactor tip erosion from arcing occurs when the contactor tips are opened under load. The arc occurs because of the inductive nature of the dynamic braking circuit. As is well known, current in an inductive circuit tends to attempt to continue to flow when the circuit is opened. This results in a rapid rise in voltage at the open circuit point, such as at the contactor tips, causing the air at the tips to ionize and provide a continuing current path through the plasma of the arc.

The present invention incorporates an arc suppression with each pair of contact tips in the dynamic braking circuit. The arc suppression circuit utilizes current bypass through unidirectional devices to divert current from the contact tips to minimize arcing. The current is preferably diverted into a storage device such as a capacitor that has a low initial impedance to allow maximum current diversion. The unidirectional device is preferably a semiconductor diode and is provided with its own protection circuit to prevent damage from high-voltage transients at initial contact tip opening. The protection circuit may be a series combination of capacitor and resistor.

BRIEF DESCRIPTION OF THE DRAWINGS

For a better understanding of the present invention, reference may be had to the following detailed description taken in conjunction with the accompanying drawing in the form of a simplified schematic representation of a vehicle system incorporating contactor tip arc suppression in one form of the invention.

DETAILED DESCRIPTION OF THE INVENTION

Referring to the drawing, there is shown a simplified schematic representation of a vehicle dynamic braking system 10 including a dynamic braking grid 12 comprising a plurality of power dissipating resistance elements 14, each connected in series with a contactor 26. While it is common practice in the industry to have a plurality of parallel connected resistance elements 14, each with its own series connected contactor, it will be recognized that the invention is not limited to use in such an arrangement but can be applied to those systems having only a single contactor with a series connected resistance element or elements and to systems having more than two parallel connected elements with corresponding contactors. The elements 14 are connected in one or more parallel circuit paths between a first power buss 16 and a second power buss 18, the busses 16 and 18 being commonly referred to as a DC link since the voltage on the link is generally a DC voltage. At one end of the link is a power source 20 which may comprise an alternator driven by a diesel engine with the output electric power from the alternator being converted to a regulated DC voltage for application to the DC link. At another end of the DC link is a power converter 22 that converts the DC link voltage to a form for application to the electric motors 24. The converter 22 may be a DC to DC converter in the case of DC electric motors or may be a DC to AC converter in the case of AC electric motors for the motors 24. In either case, the converter 22 is adapted to be bi-directional so that power can be supplied to the motors for propulsion of the vehicle and may be absorbed from the motors for dissipation in the dynamic braking grid 12 for retarding of the vehicle. While the drawing is simplified to show only a single converter 22 and motor 24, it will be appreciated that a typical electrically propelled vehicle will have multiple motors and may have one converter for all motors or one converter for one or more motors.

It is not desirable to have the dynamic braking grid 12 absorbing power during the propulsion mode of operation of the vehicle. For that reason, the grid 12 includes contactors 26 that are used to interrupt the current path through the grid 12 during propulsion. The contactors 26 are generally solenoid actuated and have contact tips 28 that physically separate to break the circuit connection to the grid 12. The structure and operation of the contactors 26 and their associated actuators are well known in the art and such contactors have been used for many years in the above described application. Accordingly, the method and apparatus for actuating and controlling the contactors is not deemed to be a part of the present invention and is not described herein except to the extent of describing how the present invention interfaces with the contactors.

As shown in the drawing, the inventors have conceived and implemented an arc suppression circuit 30 that is associated with each contactor 26 and in particular with the contactor's contact tips 28 that physically separate to break the circuit of the dynamic brake grid 12. While the drawing shows one contactor 26 for each braking resistance element 14, the system can be configured to use one contactor for a plurality of parallel resistance elements. The circuit 30 comprises a capacitor 32 connected in series with a diode 34 in a parallel circuit path with the contact tips 28. The diode 34 is poled to conduct current around the contact tips 28 so as to provide a temporary bypass path for current as the tips open. A resistor 36 is connected in parallel electrical circuit with diode 34 and is used to limit the capacitor 32 discharge current when the contact tips 28 close. The diode 34 provides a low impedance that diverts current from the contact tips 28 as the tips open. The diverted current charges capacitor 32, which capacitor is initially uncharged so as to reflect a low impedance path for the diverted current. The inductive current from the motors 24 and the wound resistance elements 14 causes a charge to accumulate on capacitor 32 during opening of contact tips 28 and immediately thereafter. When the contact tips 28 subsequently close, this accumulated charge is dissipated by current flow from capacitor 32 through resistor 36. At initial opening of contact tips 28, a large transient voltage can be developed across diode 34. In order to protect diode 34 from this transient voltage, diode 34 is provided with its own snubber circuit 38 comprising the series combination of a resistor 40 and capacitor 42.

The capacitor 32 is selected specifically to match the characteristics of the contactors 26. The value for the capacitor 32 has to be such as to absorb the current in the inductive circuit of the motors, the wiring and power resistance elements for a time sufficient to allow the contact tips to separate far enough to withstand the voltage in the circuit. For the particular contactor used in one application, the time to reach a spacing sufficient to prevent arcing varied from seven milliseconds at one selected voltage to about two milliseconds at another voltage. For a median time of about 4.5 milliseconds, with a maximum braking current of 930 amperes at 1500 volts DC, the value of the capacitor 42 can be determined to be about 2700 μf using a discharge resistor 40 of about 10 ohms. The value of the resistor 40 is selected to discharge the capacitor in about 27 milliseconds. Each of these values are to some extent selected based on the use of the vehicle in which the system may transition in and out of a braking mode every five seconds.

While the invention has been described in one embodiment, various modifications and variations will become apparent to those skilled in the art. It is intended, therefore, that the invention not be limited to the disclosed embodiment but be interpreted within the spirit and scope of the appended claims.

What is claimed is:

1. An arc suppression circuit for contact tips of a high-speed contactor, the circuit comprising:

a snubber circuit having a diode that provides a low impedance when current is diverted from the contact tips and a first capacitor connected in series circuit arrangement, the snubber circuit being connected in parallel with the contact tips of the contactor; and a protection circuit for the diode comprising a first resistor and a second capacitor connected in series, the protection circuit being connected in parallel with the diode.

2. The arc suppression circuit of claim 1, fhrther comprising:

a second resistor connected in parallel with the diode to provide a current limiting discharge path for the first capacitor upon closure of the contact tips.

3. The arc suppression circuit of claim 2, wherein the first capacitor is selected to have a value to absorb current for a time sufficient to allow the contact tips to open to a point of withstanding voltage thereacross without arcing.

4. The arc suppression circuit of claim 3, wherein the voltage applied to the contact tips is a direct current voltage.

5. The arc suppression circuit of claim 4, wherein the contact tips are connected in a dynamic braking circuit for an electric vehicle.

6. The arc suppression circuit of claim 5, wherein the diode is poled to conduct current in a bypass path about the contact tips upon opening thereof.

7. A method for protecting contact tips of a high-speed contactor from damage caused by arcing at the tips during contact opening under load, the method comprising:

providing a first current bypass path about the contact tips through a diode that provides a low impedance when current is diverted from the contact tips and a first capacitor, the first capacitor being selected to have a charge time to allow the contact tips to open to a distance sufficient to withstand voltage thereacross without arcing;

connecting a discharge resistor in parallel with the diode to allow the capacitor to discharge upon closure of the contact tips; and providing a high voltage transient bypass circuit in parallel with the diode to protect the diode at initial opening of the contact tips.

8. The method of claim 7, wherein the bypass circuit comprises a series combination of a second capacitor and a second resistor.

9. In an electric propulsion vehicle having an on-board diesel-electric power generating system for supplying electric power to a plurality of DC electric traction motors for propelling the vehicle, the traction motors being operable in an electric power generating mode during electrical braking of the vehicle and the vehicle further having a dynamic braking grid selectively coupled in parallel with the traction motors for absorbing electric power during such electrical braking, the system comprising:

at least one contactor having a pair of contact tips arranged to selectively couple the dynamic braking grid into parallel circuit arrangement with the electric traction motors during electrical braking;

a snubber circuit having a diode that provides a low impedance when current is diverted from the contact tips and a first capacitor connected in series circuit arrangement, the snubber circuit being connected in parallel with the contact tips of the contactor;

a protection circuit for the diode comprising a first resistor and a second capacitor connected in series, the protection circuit being connected in parallel with the diode; and a second resistor connected in parallel circuit arrangement with the diode for providing a current discharge pat for the first capacitor upon closure of the contact tips.

* * * * *